US009393474B2

(12) United States Patent
Smejkal et al.

(10) Patent No.: US 9,393,474 B2
(45) Date of Patent: Jul. 19, 2016

(54) CATCH NET SYSTEM FOR TRAINING BALL RELEASE

(71) Applicants: Joel James Smejkal, Columbus, NE (US); Saul E. Soltero, Columbus, NE (US)

(72) Inventors: Joel James Smejkal, Columbus, NE (US); Saul E. Soltero, Columbus, NE (US)

( * ) Notice: Subject to any disclaimer, the term of this patent is extended or adjusted under 35 U.S.C. 154(b) by 159 days.

(21) Appl. No.: 14/050,444

(22) Filed: Oct. 10, 2013

(65) Prior Publication Data

US 2015/0105188 A1 Apr. 16, 2015

(51) Int. Cl.

*A63B 63/00* (2006.01)
*A63B 69/00* (2006.01)
*A63B 71/02* (2006.01)

(52) U.S. Cl.

CPC ..... *A63B 69/0071* (2013.01); *A63B 69/0002* (2013.01); *A63B 69/002* (2013.01); *A63B 69/0095* (2013.01); *A63B 71/023* (2013.01); *A63B 63/00* (2013.01); *A63B 2069/0006* (2013.01); *A63B 2102/182* (2015.10); *A63B 2209/00* (2013.01); *A63B 2225/09* (2013.01); *A63B 2225/093* (2013.01); *A63B 2243/007* (2013.01)

(58) Field of Classification Search

CPC .... A63B 63/00; A63B 63/004; A63B 71/022; A63B 2063/002; A63B 69/0071
USPC ..... 473/447, 449, 481, 476–478; 273/398–402
See application file for complete search history.

(56) References Cited

U.S. PATENT DOCUMENTS

| | | | | |
|---|---|---|---|---|
| 3,023,001 | A * | 2/1962 | Gourdouze | 473/430 |
| 3,901,506 | A | 8/1975 | Caveney | |
| 3,929,334 | A | 12/1975 | Magazzu | |
| 3,948,517 | A * | 4/1976 | Feiler | 473/429 |
| 4,153,246 | A | 5/1979 | Byrne | |
| 4,629,188 | A * | 12/1986 | Mahieu | 473/454 |
| 4,826,164 | A | 5/1989 | Butcher | |
| 4,936,578 | A * | 6/1990 | Hudson, Sr. | 473/439 |
| 4,940,232 | A | 7/1990 | Chen | |
| 5,037,095 | A * | 8/1991 | Nedwick | 473/439 |
| 5,484,145 | A * | 1/1996 | Shriver | 473/454 |
| 6,482,112 | B1 * | 11/2002 | Betz | 473/421 |
| 7,011,310 | B2 | 3/2006 | Rowan | |
| 7,090,596 | B2 * | 8/2006 | David | 473/439 |
| 7,115,051 | B2 * | 10/2006 | Hansberry | 473/423 |
| 7,134,976 | B1 * | 11/2006 | Smith | 473/446 |
| 7,163,474 | B1 * | 1/2007 | Skinner et al. | 473/454 |
| 7,175,548 | B2 | 2/2007 | McNulty | |
| 7,976,413 | B2 * | 7/2011 | Meltzer et al. | 473/454 |
| 8,480,402 | B2 * | 7/2013 | Pecherski | 434/258 |
| 8,900,076 | B1 * | 12/2014 | Shropshire | 473/439 |
| 2005/0192126 | A1 * | 9/2005 | Remaklus | 473/447 |

FOREIGN PATENT DOCUMENTS

CN 202010402 U 10/2011

OTHER PUBLICATIONS

CN 202010402—Ruiqing Liu—English Translation.

* cited by examiner

*Primary Examiner* — Mark Graham
(74) *Attorney, Agent, or Firm* — McKee, Voorhees & Sease, PLC

(57) ABSTRACT

A catch net system and frame that allows use in many sports and in many environments for practice of ball release, etc.

4 Claims, 12 Drawing Sheets

CATCH NET SYSTEM FOR TRAINING BALL RELEASE

FIELD OF THE INVENTION

The present invention relates to a training tool for ball games, and in particular any ball game that requires release of a ball to a targeted area. It encompasses ball throwing and kicking sports such as baseball, softball, volleyball, soccer and football.

BACKGROUND OF THE INVENTION

Being good at any athletic game requires not only skill but practice. This is particularly true for games that require accurate throwing, kicking, etc. of game balls. A classic example is pitching a baseball.

As anyone knows pitching of a baseball is not easy if one desires accuracy. The strike zone of a batter is small at the distance of sixty feet six inches from the pitcher's mound to home plate and requires throwing accuracy. Throwing accuracy in turn requires knowing where in the downward movement of the arm the ball release should occur. Obviously the position of the ball release determines the accuracy of the pitch. Few if any ball catching systems are designed to teach release location and accuracy. The same is true for other sports such as softball, soccer, football, etc. In fact, typical baseball catch nets are often near the ground (strike zone) and at 60 feet 6 inches.

It is often convenient and necessary to practice alone. Indeed often the most successful practice for games requiring targeted throwing skills honed to perfection is by practicing alone. This requires a catch system for released balls.

A desirable catch system must not only teach the proper height of release, but it must affectively capture the ball and allow for convenient return for yet additional practice throws.

In addition a desirable system requires a catching frame and net system that is relatively inexpensive, effective, and useable in a variety of environments, even including for example in a basketball gymnasium.

Furthermore, a desirable catching system for thrown balls must be versatile, that is it must be suitable for a variety of sports in order to build upper arm strength and demonstrate the proper release height for a variety of trajectories. For example, for the long toss of outfield throwing, proper trajectory for throwing from third to first base, proper pitching release point, the proper home plate catcher release on a point on a throw to second base, and even the proper hitting point for targeted hitting trajectory.

The present system is designed to be suitable for all of the environments above mentioned and to provide a composite system for training athletes to properly release game balls whatever their desired sporting pursuit may be.

The method and manner of accomplishing the above objectives as well as others will become apparent from the detailed description of the invention.

SUMMARY OF THE INVENTION

An adjustable catch net system for training athletes in releasing game balls. The system involves an adjustable height catch net frame, adjustable opening size catch net frame, and a catch net, preferably having an associated sock net to dissipate energy. In this way the height of the frame can be adjusted, and the opening of the frame can be adjusted, and all of this can be with a variety of associated frame openings.

DETAILED DESCRIPTION OF THE PREFERRED EMBODIMENTS

Figure 1:
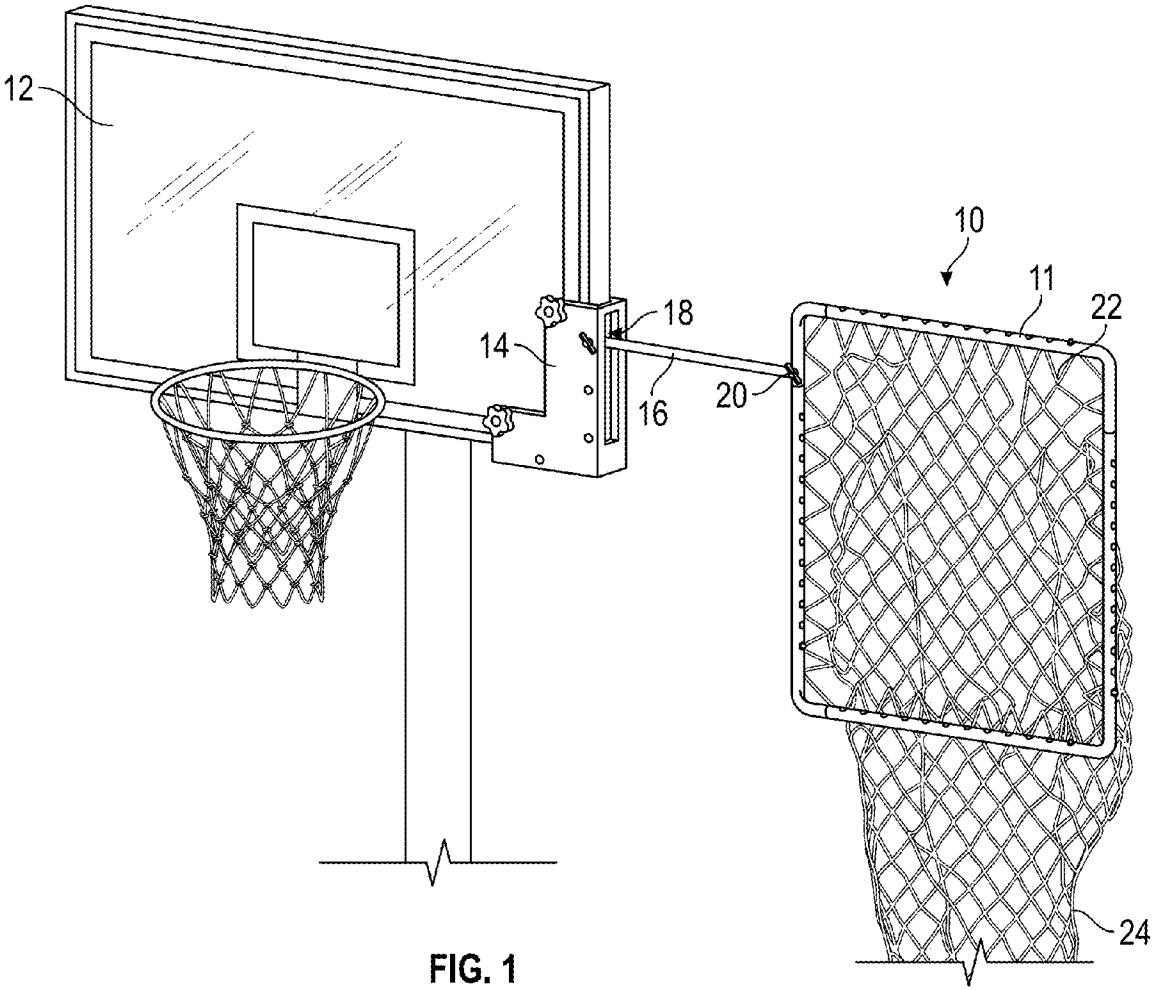
FIG. 1 is a perspective view of a single arm height adjustable system for clamping to a basketball bang board.

As shown in the drawings a variety of different construction combinations may be used to achieve the results of the present invention. All have in common an adjustable height target or catching frame, an adjustable opening for the catching frame and a catch net. Those systems shown in the drawings are for illustrative purposes only and represent preferred embodiments for desired purposes, but it is understood that other systems may be designed falling within the spirit and scope of the present invention that have the general characteristics as described.

As shown in FIG. 1, catching frame 10 is mounted to the corner of a basketball bang board 12 with a clamp system 14. A mounting arm 16 may be adjusted up and down within the clamp framework 14. The adjustable mounting for arm 16 is at one end 18 of arm 16 with the other end 20 of the arm fixedly attached to the catch frame 10.

Figure 2:
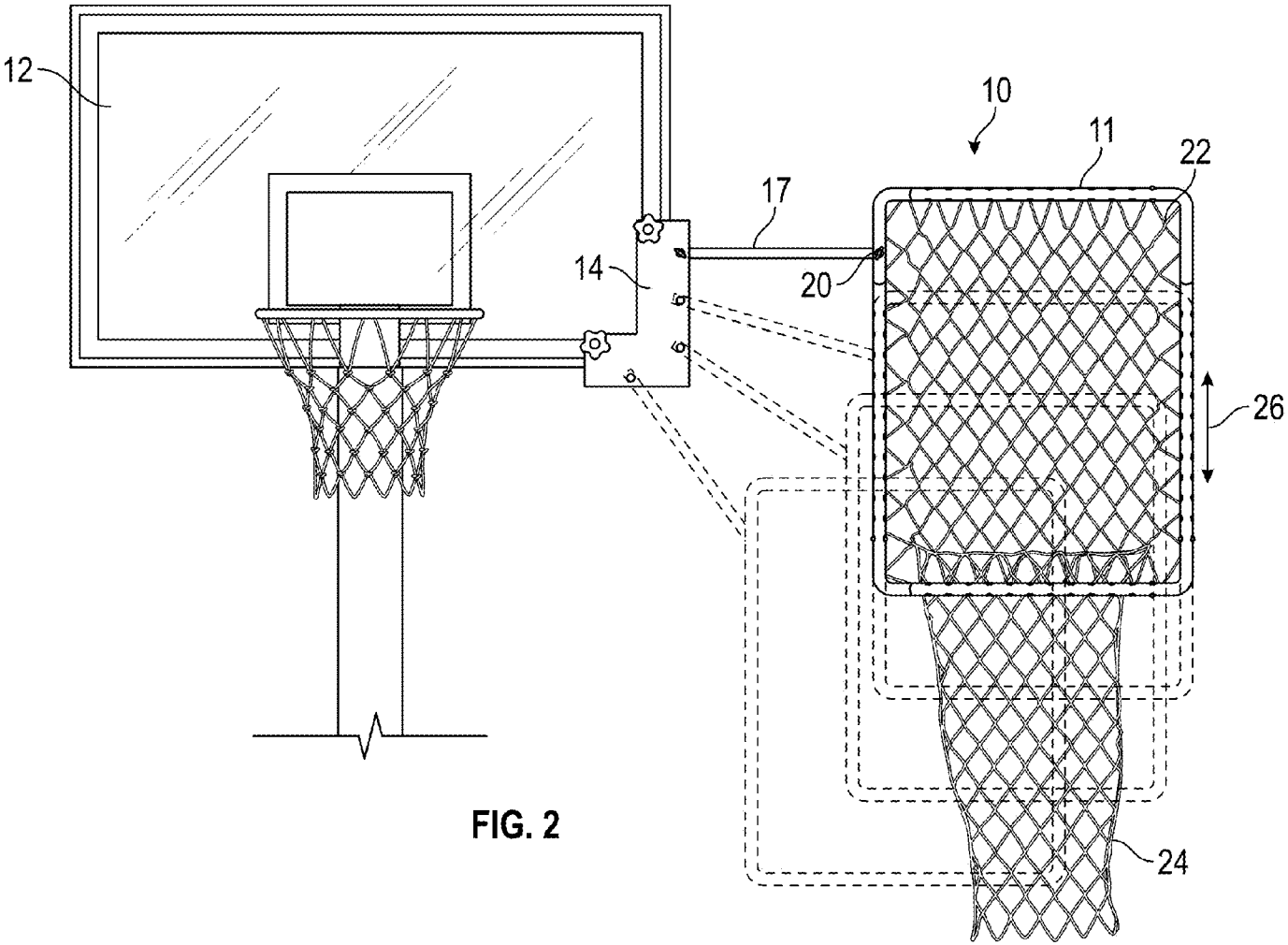
FIG. 2 is the system of claim 1 showing height adjustment.
Figure 3:
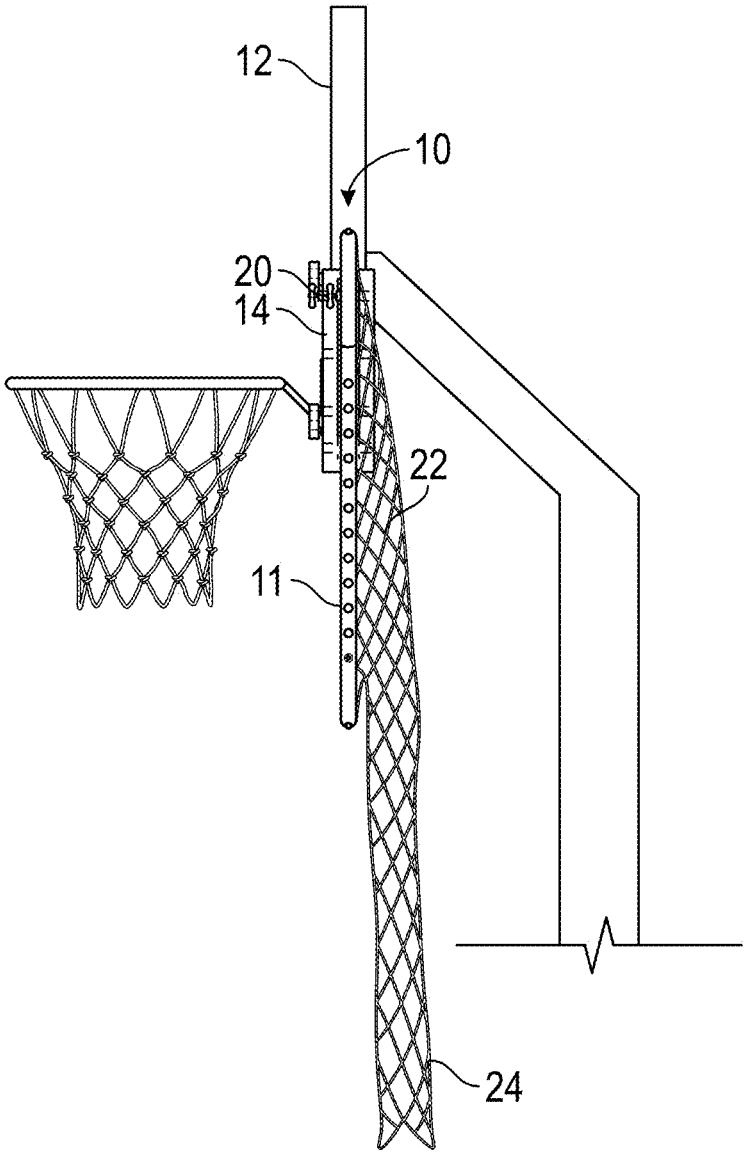
FIG. 3 is a side view of the system of FIG. 1.

Catch frame 10 may be a fixed non-adjustable target or it may have its target area adjustable. FIG. 1 shows a non-adjustable target frame. FIG. 2 shows an adjustable target frame 11. Attached to the target frame 10 or 11 is a webbed catch net 22. As best seen in FIG. 3 catch net 22 as it dissipates energy of the ball has an associated sock net 24 which then restrains the ball for return and rethrowing. Ideally the catch net and the sock net are made of the same fabric webbing material but other webbing like plastic may also be used if desired.

FIG. 2 shows an embodiment like FIG. 1 except that the clamp 14 has a swing arm 17 to allow it to move between various height positions as illustrated in the dotted relationships. Frame 11 is adjustable to a larger or smaller opening in the catch frame 11 as indicated by arrow 26. FIG. 3 shows the system of FIG. 1 in side view with a collapsed sock net.

Figure 4:
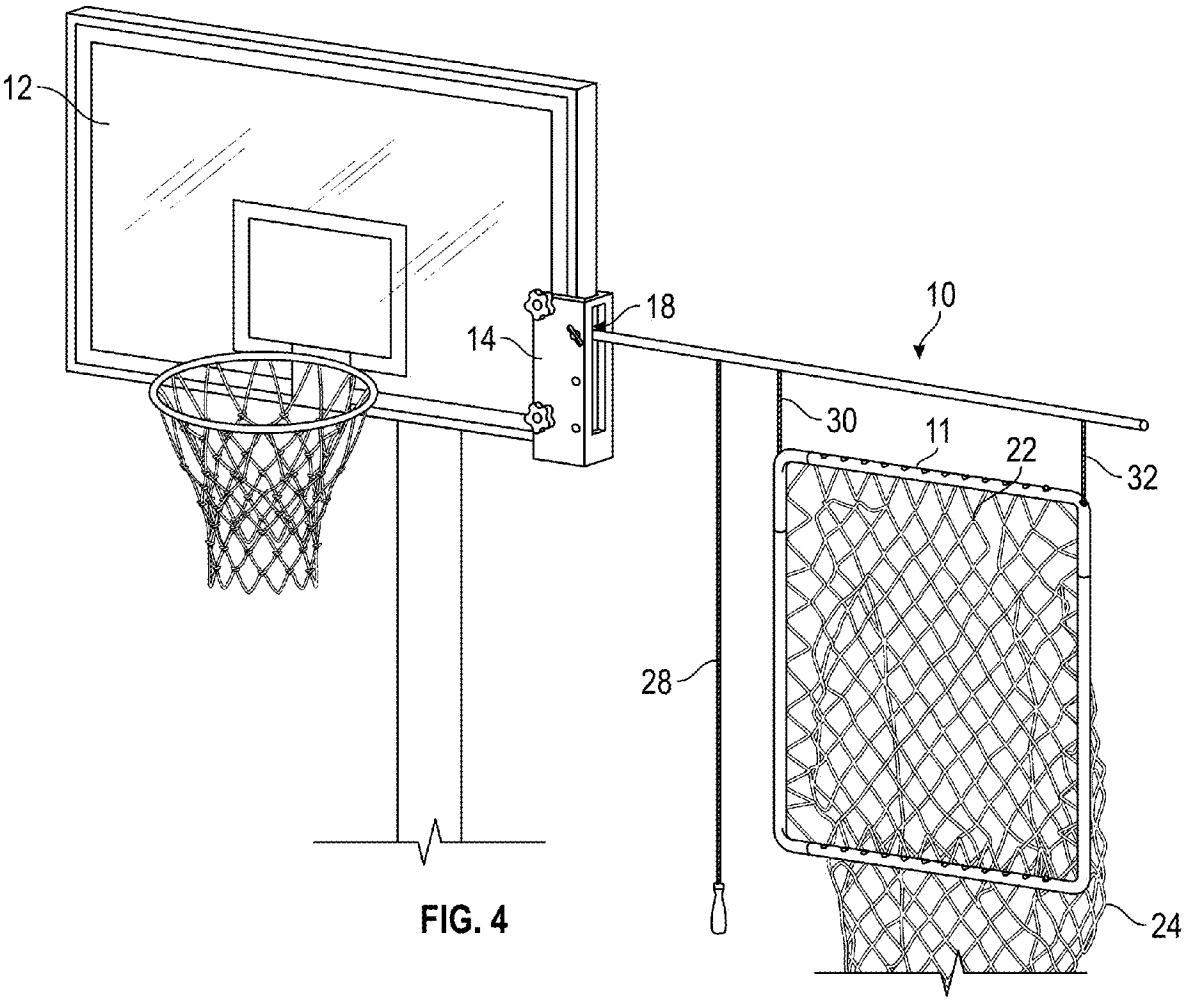
FIG. 4 is a front view of a system, like FIG. 1, but with infinite height adjustment.
Figure 5:
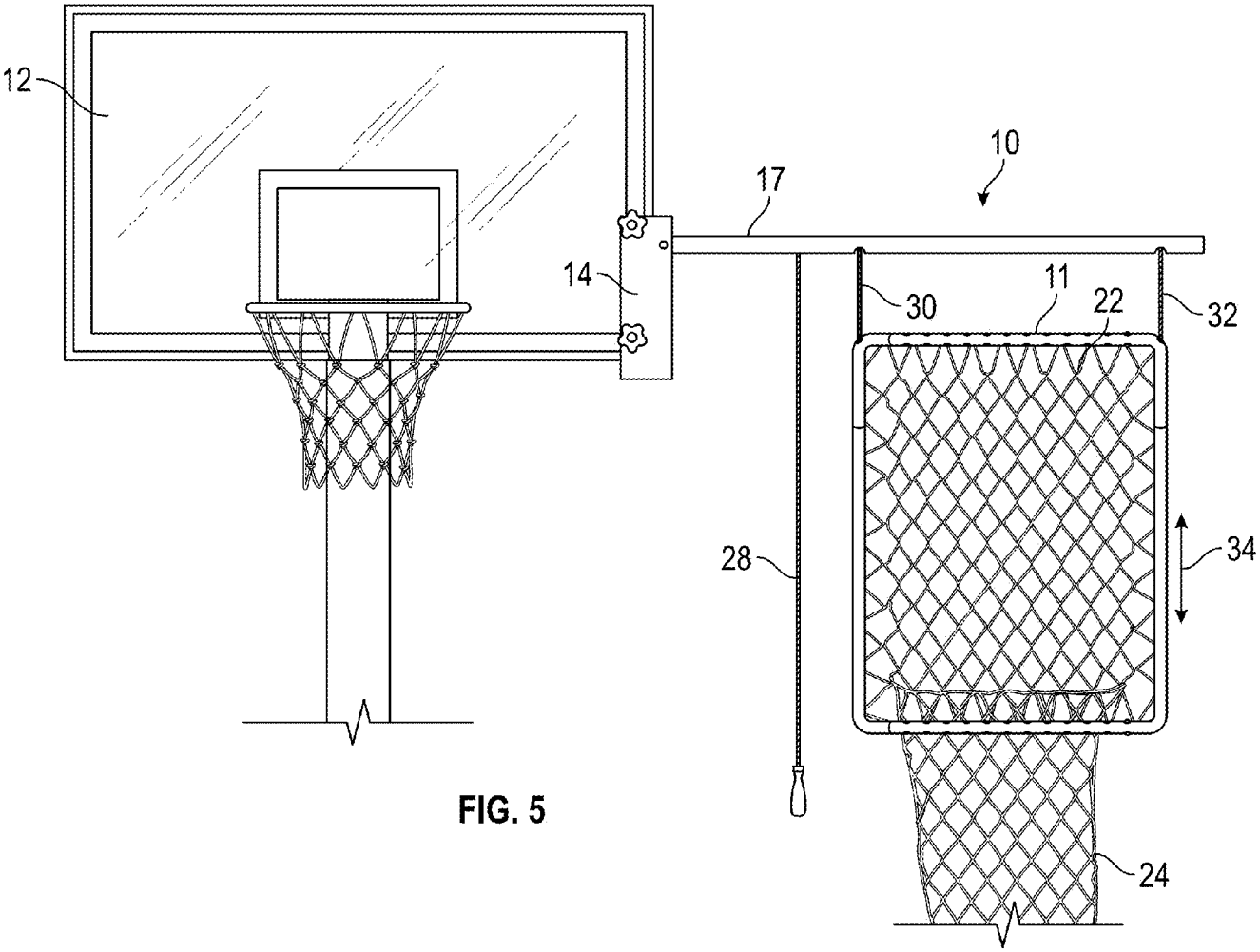
FIG. 5 is a front view of the system of FIG. 4.
Figure 6:
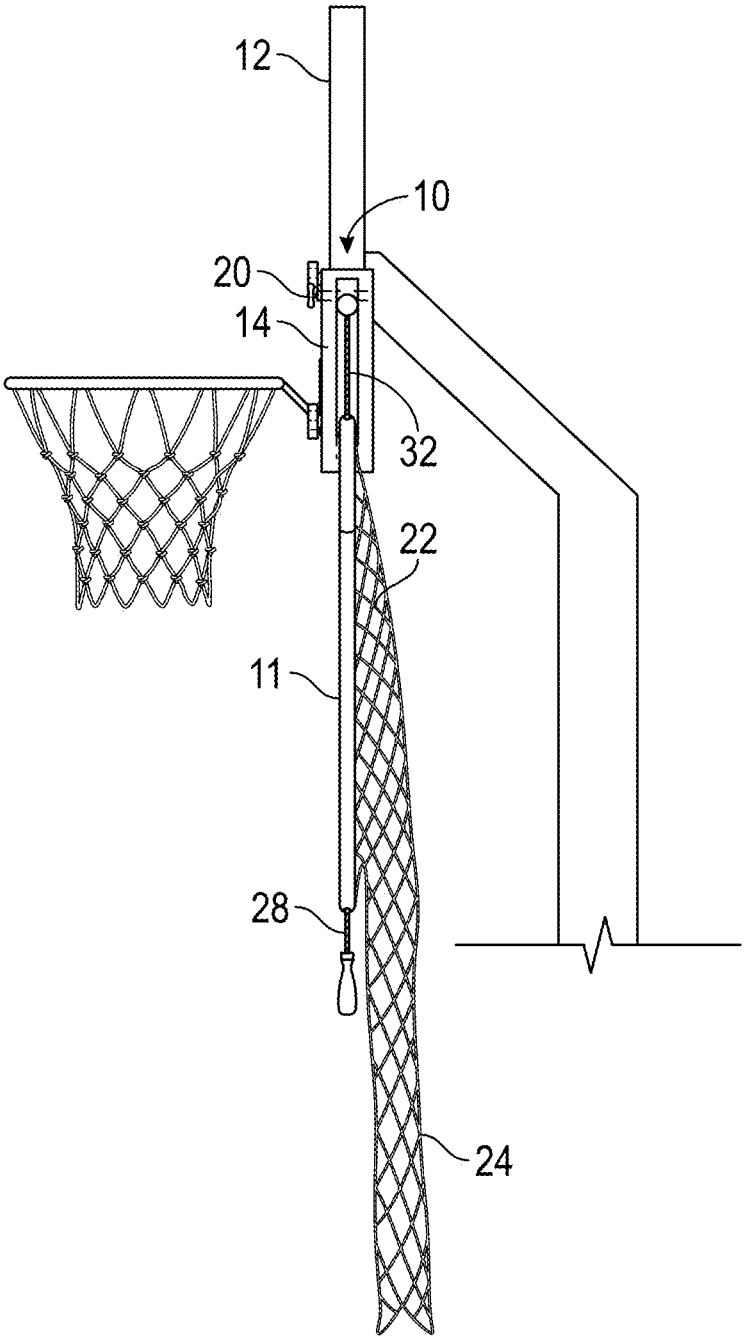
FIG. 6 is a side view of the system of FIG. 4.

FIG. 4 shows a system like FIG. 2 but an alternate way of height adjustment by pulling cord 28 to adjust the height of attaching ropes 30, 32. FIG. 5 shows a similar mechanism of height adjustable method for catch frame 11 as indicated by arrow 34. FIG. 6 is a side view of the system of FIG. 4.

Figure 7:
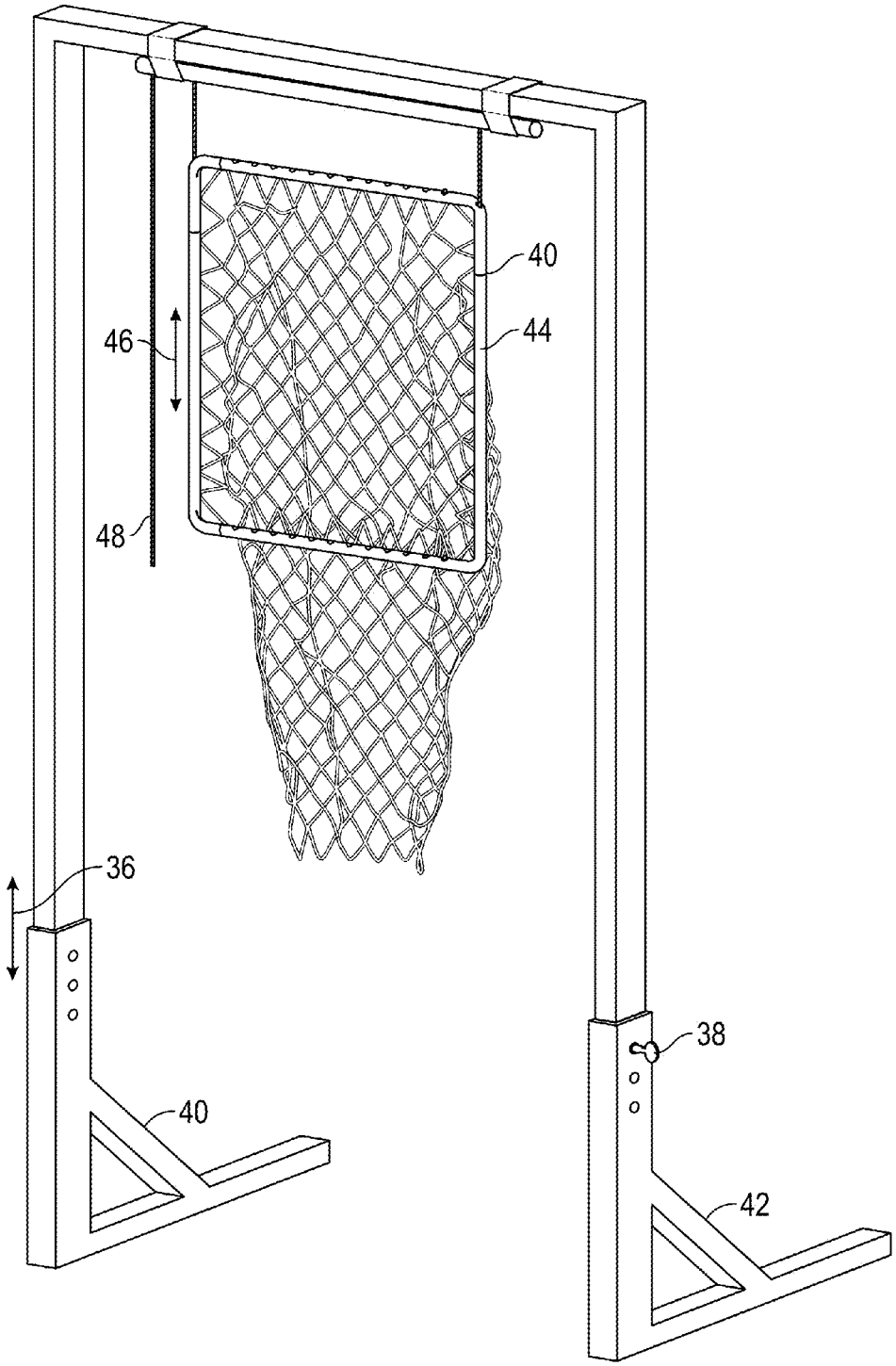
FIG. 7 is an alternate system with a stand alone mounting system, and height adjustment.

FIG. 7 shows another alternative embodiment stand alone frame 36 telescopically adjustable 38 with legs 40, 42. A catch frame 44 that is also adjustable for target opening as indicated by arrow 46.

The height of the catch frame 40 inside of the overall custom frame 36 can be further adjusted or refined for height adjustment by simply pulling cord 48.

Figure 8:
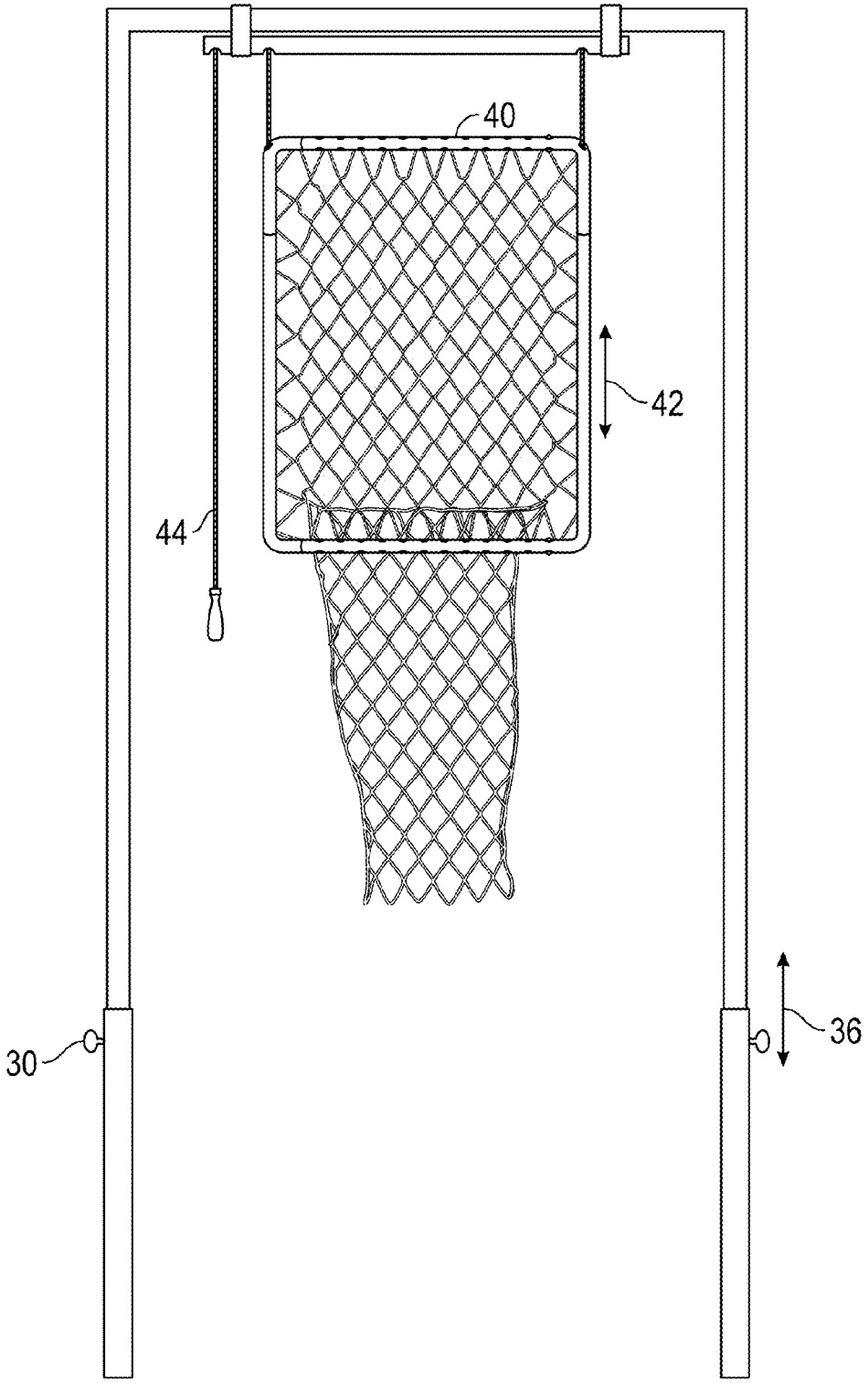
FIG. 8 is a front view of the system of FIG. 7.
Figure 9:
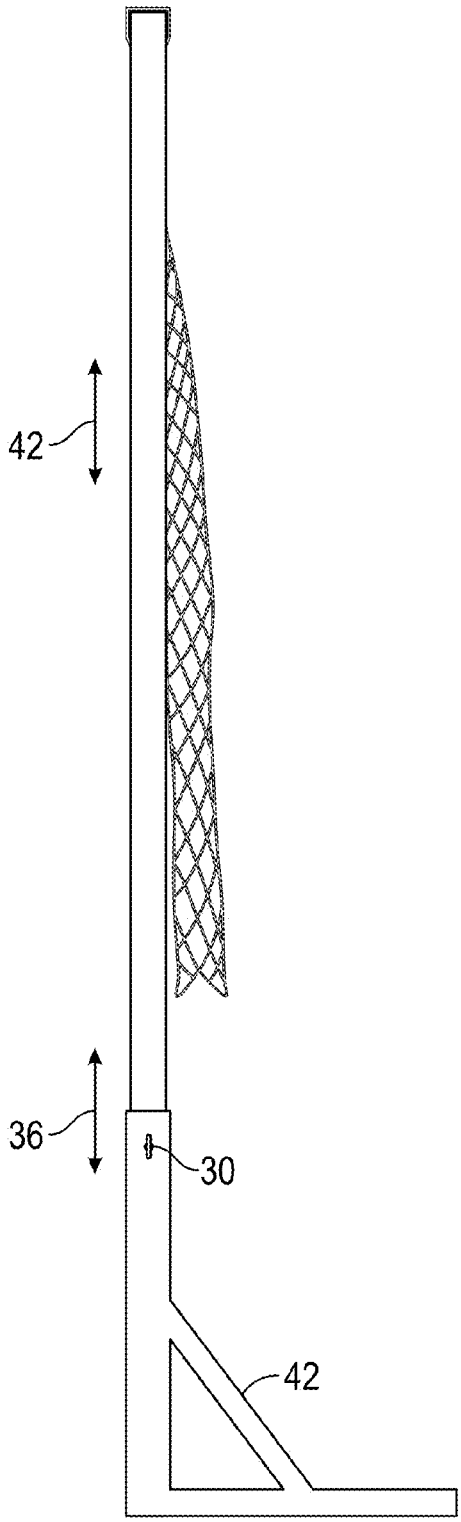
FIG. 9 is a side view of the system of FIG. 7.

FIG. 8 shows a front view of the embodiment to FIG. 7. FIG. 9 is a side view of FIG. 7, with a collapsed sock net.

Figure 10:
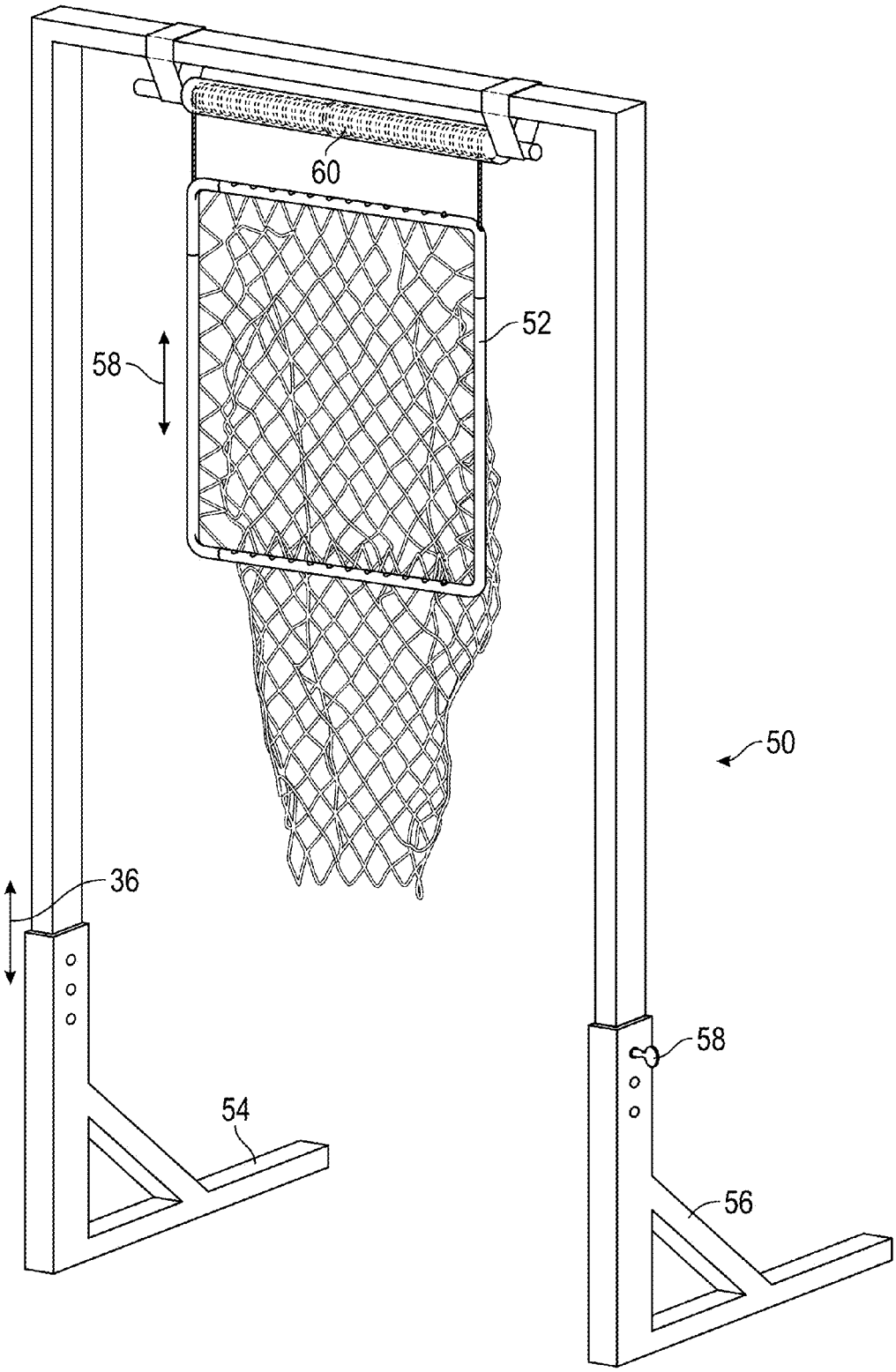
FIG. 10 is a stand alone system with infinite height adjustment of the catch net.
Figure 11:
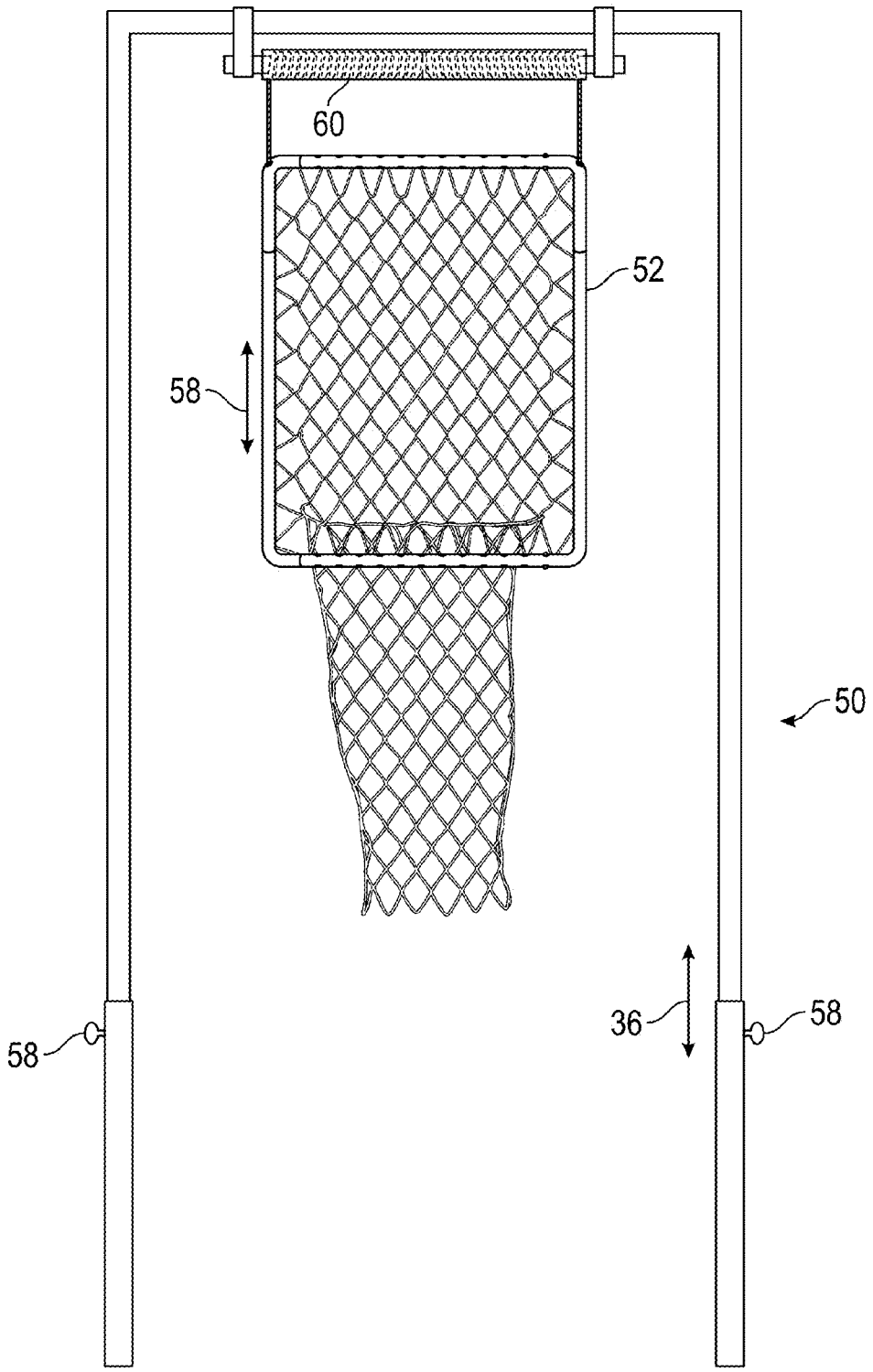
FIG. 11 is a front view of the system of FIG. 10.
Figure 12:
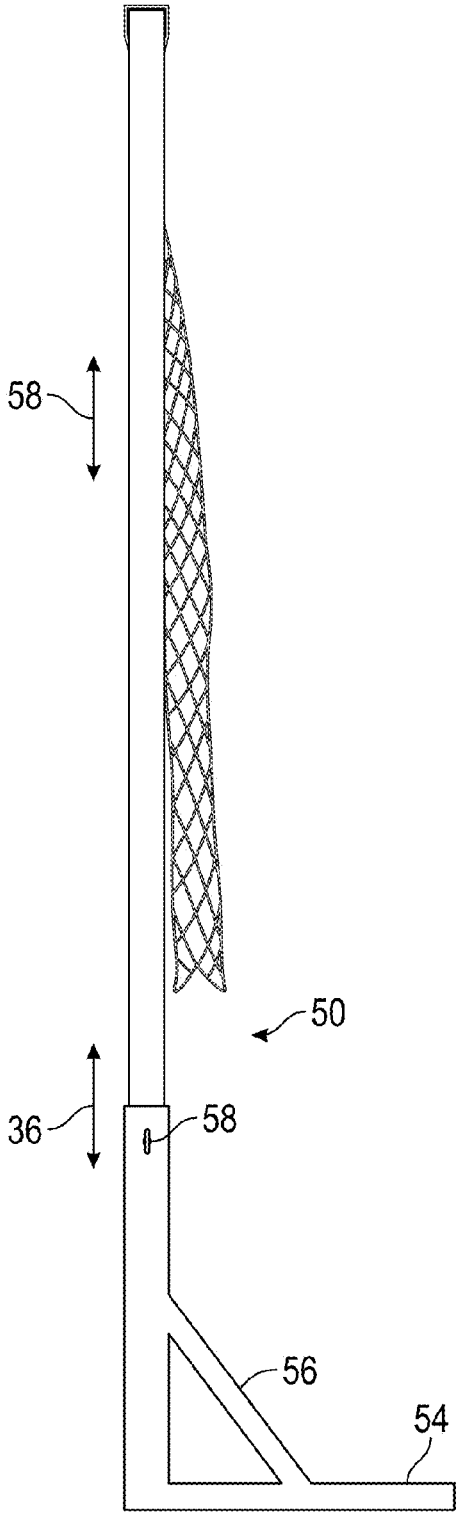
FIG. 12 is a side view of the system of FIG. 10.

FIGS. 10, 11 and 12 shows an embodiment that might be described in laymen terms as the shade embodiment, again using a stand alone frame 50, catch frame 52 and frame legs 54, 56 with height adjustment 58. Frame 52 can be open or closed as directional arrow 58 indicates and its height adjusted by pulling frame 32 up or down via shade mechanism 60.

Each of the four embodiments shown: FIG. 1-3, FIG. 4-6, FIG. 7-9, and FIGS. 9-12 can be used with equal satisfaction depending upon the circumstances to provide infinite adjustability to height and target opening and therefore allow both release and accuracy training.

The mounting bracket offers a number of selectable positions to adjust the catching frame height to a target position for different throwing (or hitting) trajectories. Each position simulates various "on the field" throwing distance and the recommended ball trajectory. This target position helps the athlete learn the proper ball release point out of the hand for a thrown ball.

One design of the catch net system involves a stationary arm which is mounted to a basketball backboard (FIG. 5) or stand alone frame (FIG. 7). This catch net hangs below the stationary arm and can be adjusted to multiple throwing target heights using a cord mechanism similar to how a window blind is adjusted. The cord is pulled to raise or lower the catch net frame to heights which promote the "out of the hand" release point to develop the proper throwing trajectory for athletes of all sizes. See FIG. 4.

The training system can also be for small practice areas, both indoors or outdoors. When larger practice fields are not available or when bad outdoor weather, this catching frame/net system provides the athlete a catching system for individual training either indoors or outdoors. Often, gymnasiums, backyards, and indoor buildings do not offer sufficient space for full distance throwing drills. This system provides a target height of the proper throwing trajectory so the athlete can make a full strength throw in confined spaces (FIGS. 1-6).

The system also offers versatility. It provides an adjustable target to promote proper ball flight of a hit ball. The catching frame/net is a target and catch system which can be positioned to develop a baseball/softball batter or racquet sport player.

Baseball: The device is positioned a short distance away from the hitter. The hitter will hit the ball into the catching frame/net target. The catching frame height can be adjusted to provide a target for a fly ball, line drive or groundball.

Tennis/Racquet Sports: The device will be positioned a short distance away from the hitter. The hitter will hit the ball into the catching frame/net target. The catching frame height can be adjusted to provide a target for an overhead serve or service return.

Volleyball: The device will be positioned a short distance away from the hitter. The hitter will hit the ball into the catching frame/net target. The catching frame height can be adjusted to provide a target for bumped or spiked ball.

As can be seen a truly versatile and infinitely adjustable system is available, useful in many sports and many environments. It therefore accomplishes its intended purposes and objectives.

What is claimed is:

1. An adjustable catch net system for training athletes, comprising:

a means for attaching said system to a basketball bang board;

a fixed height rotatable mounting arm having ends, one of which is mounted to said catch net system, and the other adjustable mounted to a catch frame; and said catch frame having an arm attached catch net which can be raised and lowered by rotating the rotatable mounting arm by winding and unwinding an attached cord which is also attached to said catch frame.

2. The system of claim 1 wherein said catch net frame is adjustable to expand or contract target size.

3. The system of claim 2 wherein said net has an associated sock net for restraining balls thrown into the catch net after their energy has dissipated.

4. The system of claim 3 wherein the catch net and sock net are both made of fabric webbing.

* * * * *